US009175891B2

(12) United States Patent
Lundberg et al.

(10) Patent No.: US 9,175,891 B2
(45) Date of Patent: Nov. 3, 2015

(54) METHOD AND SYSTEM FOR A PORTABLE REFRIGERANT RECOVERY UNIT LOAD CONTROLLER

(71) Applicant: Robert Bosch GmbH, Stuttgart (DE)

(72) Inventors: Dylan Lundberg, Lonsdale, MN (US); Mark McMasters, Owatonna, MN (US)

(73) Assignee: Bosch Automotive Service Solutions Inc., Warren, MI (US)

( * ) Notice: Subject to any disclaimer, the term of this patent is extended or adjusted under 35 U.S.C. 154(b) by 377 days.

(21) Appl. No.: 13/730,339

(22) Filed: Dec. 28, 2012

(65) Prior Publication Data

US 2014/0182312 A1 Jul. 3, 2014

(51) Int. Cl.
*F25B 45/00* (2006.01)

(52) U.S. Cl.
CPC ..... *F25B 45/00* (2013.01); *F25B 2345/002* (2013.01); *F25B 2345/003* (2013.01); *F25B 2345/0051* (2013.01)

(58) Field of Classification Search
CPC .... F25B 45/00; F25B 49/022; F25B 2345/00; F25B 2345/003; F25B 2345/005; F25B 2345/006; F25B 2400/0401; F25B 2500/07; F25B 2600/026; F25B 2600/2501
USPC ..... 62/77, 149, 196.1, 196.3, 230, 292
See application file for complete search history.

(56) References Cited

U.S. PATENT DOCUMENTS 6,966,194 B2 * 11/2005 Yokozeki et al. ..... 62/196.3
2009/0241560 A1 * 10/2009 Murray et al. ..... 62/77

* cited by examiner

*Primary Examiner* — Marc Norman
(74) *Attorney, Agent, or Firm* — Baker & Hostetler LLP

(57) ABSTRACT

A system and methods associated therewith for providing a load controller for a refrigerant recovery unit are disclosed. The load controller can be controlled to operate when the current drawn by the motor increases due to pressure changes caused by abnormal refrigerant flow or during activation of the motor in order to lower the pressure. In some aspects of the present disclosure, the load controller can lower the pressure by recirculating some of the pressure load through the opening of a compressor bypass loop line. In some embodiments, the current/pressure load may be monitored during the operation of the refrigerant recovery unit and set to act as an emergency shut off and alert system to the user when the system malfunctions.

16 Claims, 6 Drawing Sheets

METHOD AND SYSTEM FOR A PORTABLE REFRIGERANT RECOVERY UNIT LOAD CONTROLLER

FIELD OF THE DISCLOSURE

The disclosure generally relates to a refrigerant recovery unit. More particularly, the disclosure relates to a load controller system and method associated therewith.

BACKGROUND OF THE DISCLOSURE

Refrigerant recovery units are used for the maintenance and servicing of refrigerant systems including, for example, air conditioning systems. Refrigerant recovery units include a compressor with a motor that is used to recover and recharge the refrigerant from the air conditioning system. The design specifications of the compressor's motor must be so that the torque capabilities, among other sizing factors, of the motor are sufficient for the unit to operate accordingly. However, motor design specifications are also frequently limited by size, weight, physical footprint, and cost of the units.

In addition to these limitations, energy preservation is also of utmost importance. Conventional energy efficient system designs that include lower torque motor specifications often result in smaller motors that use less power, and remain relatively portable and low cost. However, operation complications during the startup of the unit or during normal operation when refrigerant flow restrictions occur often bring about undesired field solutions to get the refrigerant recovery units to start up or continue to work. Thus, a need exists for additional systems and methods that can provide energy efficiency and operation solutions for said portable refrigerant recovery units.

SUMMARY OF THE DISCLOSURE

Accordingly, the foregoing needs are met, to a great extent, by the present disclosure, wherein methods and a system associated with a load controller for refrigerant recovery units are provided.

In some embodiments on the disclosure, a method of controlling a load of a refrigerant recovery unit includes receiving refrigerant from a refrigerant system through one or more service hoses that can provide fluid communication from the refrigerant system to the refrigerant recovery unit, drawing sufficient current to energize a compressor's motor with a start relay, and activating with the motor's start relay a solenoid valve to open a flow path in a compressor bypass loop line to thereby decreasing a pressure load on the compressor's motor upon energization.

In additional embodiments of the disclosure, the method of controlling the load of a refrigerant recovery unit can include receiving refrigerant from a refrigerant system through one or more service hoses that can provide fluid communication from the refrigerant system to the refrigerant recovery unit, drawing sufficient current to energize a compressor's motor with a start relay, monitoring with a controller the current drawn by the compressor's motor, and activating with the controller a solenoid valve to open a flow path in a compressor bypass loop line to thereby decreasing the current drawn by the compressor's motor upon an increase in the current drawn by the compressor's motor above a predetermined threshold.

In yet additional embodiments of the disclosure, a system for controlling a compressor's load in a refrigerant recovery unit can include one or more fittings to connect service hoses that provide fluid communication between a refrigerant system and the refrigerant recovery unit, a compressor having an outlet connection and an inlet connection, a compressor bypass loop line with a first end of the compressor bypass loop line connected to a first line connected to the inlet of compressor and a second end of the compressor bypass loop line connected to a second line connected to an outlet of the compressor, and a solenoid valve can be capable of opening the compressor bypass loop line when the current drawn by the compressor's motor increases above a predetermined threshold.

There has thus been outlined, rather broadly, certain aspects of the disclosure in order that the detailed description herein may be better understood, and in order that the present contribution to the art may be better appreciated. There are, of course, additional aspects of the disclosure that will be described below and which will form the subject matter of the claims appended hereto.

In this respect, before explaining at least one embodiment of the disclosure in detail, it is to be understood that the disclosure is not limited in its application to the details of the construction and to the arrangements of the components set forth in the following description or illustrated in the drawings. The disclosure is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

DETAILED DESCRIPTION OF THE DISCLOSURE

Figure 1:
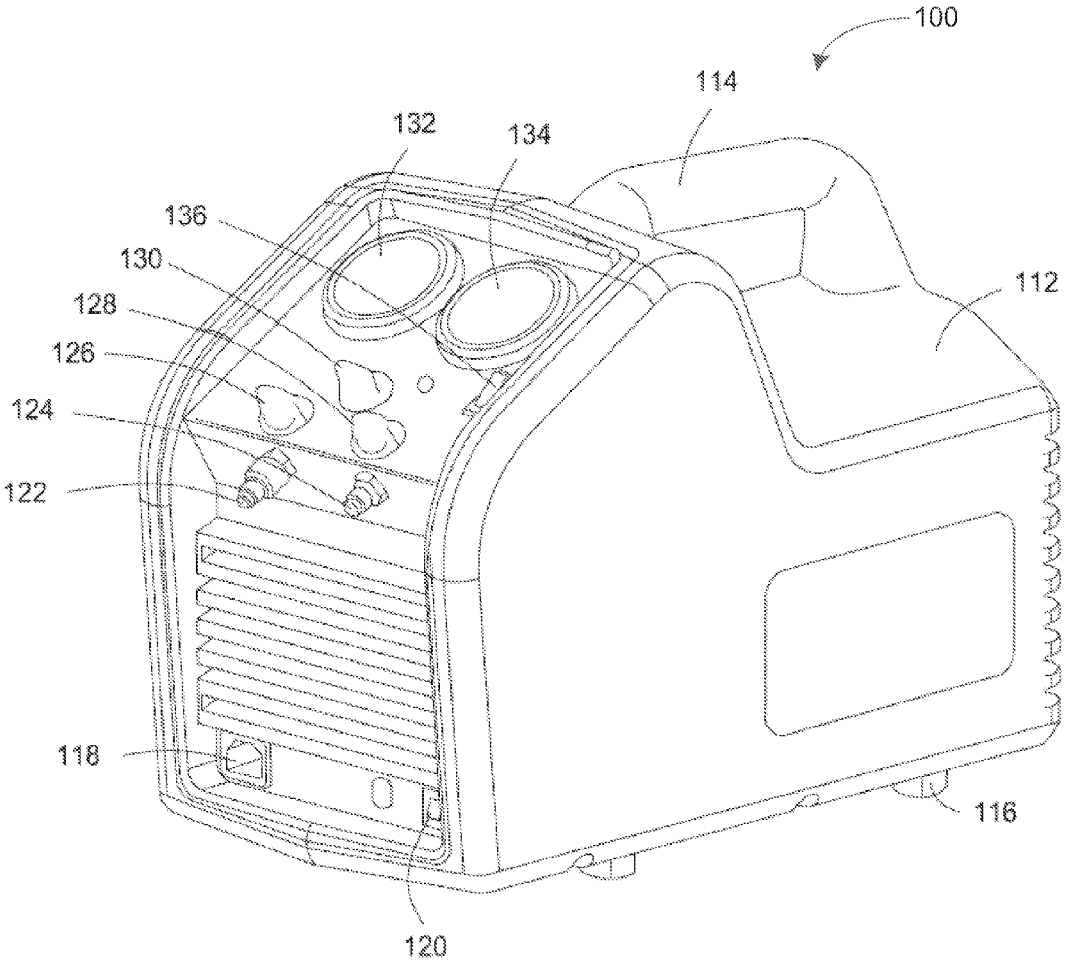
FIG. 1 is a perspective view of an exemplary refrigerant recovery unit in accordance with aspects of the disclosure.

In some aspects of the disclosure, the load controller can be used to decrease the current/pressure load placed on the compressor's motor during activation and/or during abnormal refrigerant flow, and as a result, may lower the torque requirements of the motor. Moreover, because higher load requirements at these stages can result in either a need in specifying motors with higher torque capabilities and energy consumption or in less than ideal field solutions to reduce the pressure load, the disclosure provides for a safe solution that can keep lower motor torque specification requirements, and in doing so, conserving energy.

In some embodiments of the disclosure, a solenoid valve of the load controller of the system can be synchronized to operate with the start relay of the motor. The solenoid valve can be used to open and close a refrigerant flow path in the compressor bypass loop line to lower the torque required when the start relay of the motor is activated due to a significantly higher current being drawn by the motor. More specifically, the opening of the compressor bypass loop line which may bypass and lower some of the pressure load to thereby lower the current drawn by the motor when the system is most susceptible to higher pressure loads.

Susceptibility to higher pressure loads may occur during the activation of the motor of the compressor and during abnormal flow of refrigerant into refrigerant recovery units. Because of the higher pressure load during the compressor's motor activation, portable refrigerant recovery units with specified motors designed for optimal flow conditions can have trouble starting up. Currently, users experiencing activation problems, sometimes as a field solution, vent refrigerant out a purge path of the system in order to startup the unit. However, not all units experiencing this startup problem include a purge path, and for those that do, venting refrigerant out of the system is an unwanted solution that may get the unit to start up but can result in exposing and losing refrigerant to the surrounding environment.

Consequently in some aspects of the disclosure, the load controller provides a safe solution and increased efficiency by allowing the motor's specifications to be designed with lower torque requirements. Lower torque requirements can be achieved using the load controller's solenoid regulated compressor bypass loop line that can operate to lower the pressure/current load during startup and/or abnormal refrigerant flow.

As previously mentioned, the load controller may be in logical connection and synchronized to operate with the start relay of the motor. However, in more complex alternative embodiments, the load controller may additionally or alternatively operate with a controller in logical connection with the load controller components. Components can be a sensor, switch, or transducer, including but not limited to, one or more solenoid valves, pressure transducers and/or current meters. The controller can cause the load controller to be active by activating the solenoid valve regulating the refrigerant flow path of the compressor bypass loop line or inactive to close the refrigerant flow path of the regulated compressor bypass loop line according to measured data from the one or more components in communication with the controller. The disclosure will now be described with reference to the exemplary embodiments depicted in the drawing figures, in which like reference numerals refer to like parts throughout.

Beginning with FIG. 1, a perspective view illustrating an exemplary portable refrigerant recovery unit 100 according to aspects of the disclosure is depicted. The refrigerant recovery unit 100 includes an enclosure 112 that may be made from molded plastic and the like. The enclosure 112 can be designed to enclose the major components of the refrigerant recovery unit 100 as discussed herein. The portable refrigerant recovery unit 100 can also include a handle 114 for a user to move the refrigerant recovery unit 100 from one place to another. The handle 114 can be made from the same material as the enclosure 112 or from an elastomeric material for more comfort to the user. Feet 116 can be positioned on a bottom portion of the enclosure 112 in order to keep the refrigerant recovery unit 100 from touching the ground.

A power connection 118 can be used to provide power to the refrigerant recovery unit 100 when plugged into a power source (not shown). A circuit breaker 120 can be provided to protect the refrigerant recovery unit 100 from any surge in the power source. In one embodiment, the circuit breaker 120 and power connection 118 can be provided on a front portion of the refrigerant recovery unit 100.

The front portion of the refrigerant recovery unit 100 also includes an inlet fitting 122 and an outlet fitting 124. The inlet fitting 122 can be used to receive refrigerant from a refrigerant containing system (not shown), such as an air conditioning system, and the outlet fitting 124 can be used to send the recovered refrigerant to the refrigerant containing system (not shown). The inlet fitting 122 can include a replaceable filter (not shown) to remove any contaminants that may be in the recovered refrigerant of the refrigerant containing system (not shown). A control knob 126 can be used to control the functionality of the inlet fitting 122 and a control knob 128 can control the functionality of the outlet fitting 124. A self purge knob 130 can be provided to purge contaminants or remaining refrigerant from the refrigerant containing system. High side and low side pressure gauges 132 and 134 can be provided on a top surface to show the respective pressures. A power button 136 can also provided on the top surface to turn on and off the refrigerant recovery unit 100.

Figure 2A:
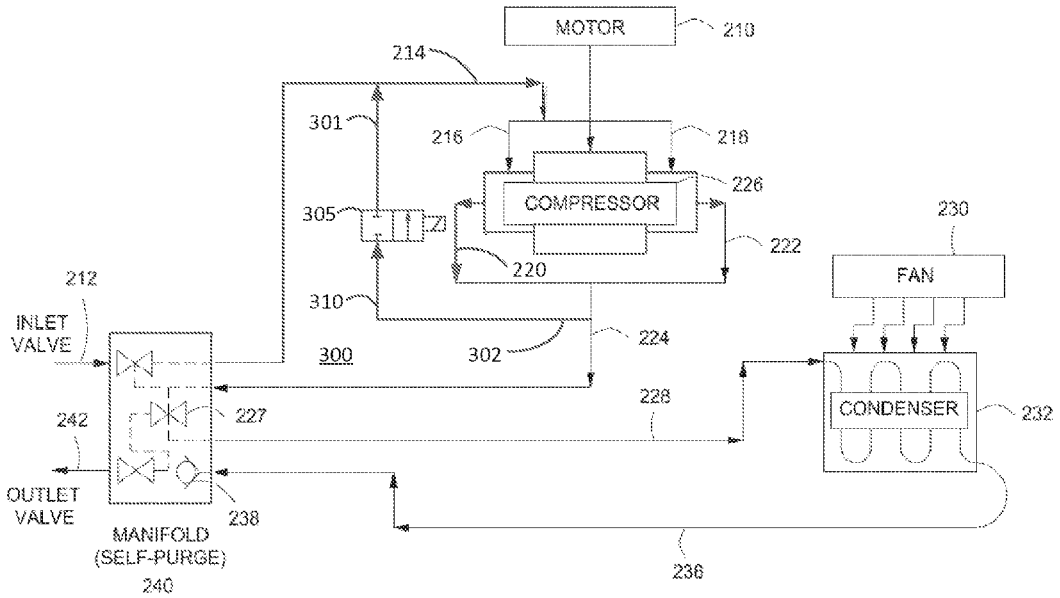
FIG. 2A illustrates components of an exemplary refrigerant recovery unit in accordance with aspects of the disclosure.
Figure 2B:
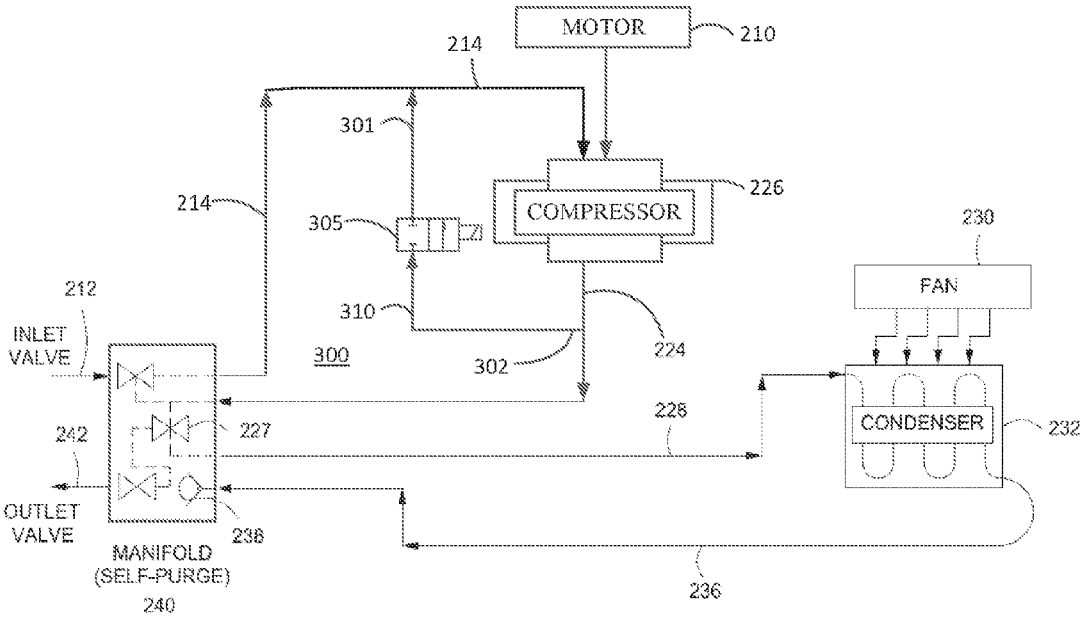
FIG. 2B illustrates components of yet another exemplary refrigerant recovery unit in accordance with aspects of the disclosure.

Referring now to FIGS. 2A and 2B, components of the refrigerant recovery unit 100 in accordance with aspects of the present disclosure are illustrated. FIG. 2B differs from FIG. 2A in that a flow path 214 is divided into two to provide a more even distribution for pistons (not shown) in a compressor 226 to reciprocate accordingly. Additionally, although like reference numerals refer to like parts throughout, this is not to imply that referenced parts or equivalents in relation to any one aspect may not be used alone, excluded, or used in combination with other parts described in other embodiments.

Referring back to FIGS. 2A and 2B, a motor 210 can be coupled to a compressor 226. The inlet fitting 122 can include an inlet valve 212 that may be controlled by the control knob 126 to open or close. As noted, the refrigerant from the refrigerant containing system (not shown) can enter the inlet valve 212 and flow to the compressor 226 as shown in a flow path 214. In some embodiments, including but not limited to the exemplary embodiment depicted in FIG. 2A, the flow path 214 may split into flow paths 216 and 218 that enter into separate cylinders (not shown) of the compressor 226.

The motor 210 operates to cause the pistons in the cylinders in the compressor 226 to force the refrigerant at the respective ends of the compressor 226 into one or more flow paths. For example, in FIG. 2A the refrigerant is forced into two flow paths 220 and 222, which combine back into a single flow path 224. As depicted in FIG. 2B, the refrigerant can be pushed into a single flow path 224 and then proceed through a valve 227. Valve 227 can relate, for example, to a purge function of the refrigerant recovery unit 100. From valve 227, the refrigerant can travel via flow path 228 into a condenser 232. A fan 230 can help keep the condenser 232 cool while it is operating.

In accordance with the present disclosure, a load controller 300 system and associated methods can be implemented by the refrigerant recovery unit 100 to relieve the higher pressure loads the compressor's motor 210 is subjected to during start up and/or during abnormal refrigerant flow. As depicted in FIGS. 2A and 2B, the load controller 300 comprises a compressor bypass loop line 310 with a first end 301 connected to the flow path 214 going into an inlet of the compressor 226 and a second end 302 connected to the flow path 224 connected to the compressor's 226 outlet. The compressor bypass loop line 310 may be a flexible hose or any other suitable conduit providing a liquid connection therebetween. The fluid connection provided by the compressor bypass loop line 310 may be open or close using a solenoid valve 305 to lower the pressure/current load. In accordance to the methods later described herein, in some embodiments the load controller 300 can be synchronized to operate when a start relay (not shown) of the motor 210 is active, and in other embodiments, additionally or alternatively, with a controller 320 in logical connection to one or more components, such as a pressure transducers 303, 304 and/or a current meter 306, e.g. see FIG. 3.

The refrigerant can flow from the condenser 232 to an outlet valve 242 via a flow path 236. A check valve 238 can be provided in a manifold 240 in order to allow flow of refrigerant only from the condenser 232 to the outlet valve 242 and not from the refrigerant system (not shown) into the refrigerant recovery unit 100. The manifold 240 can include the inlet valve 212, the outlet valve 242, the valve 227, and the check valve 238.

Figure 3:
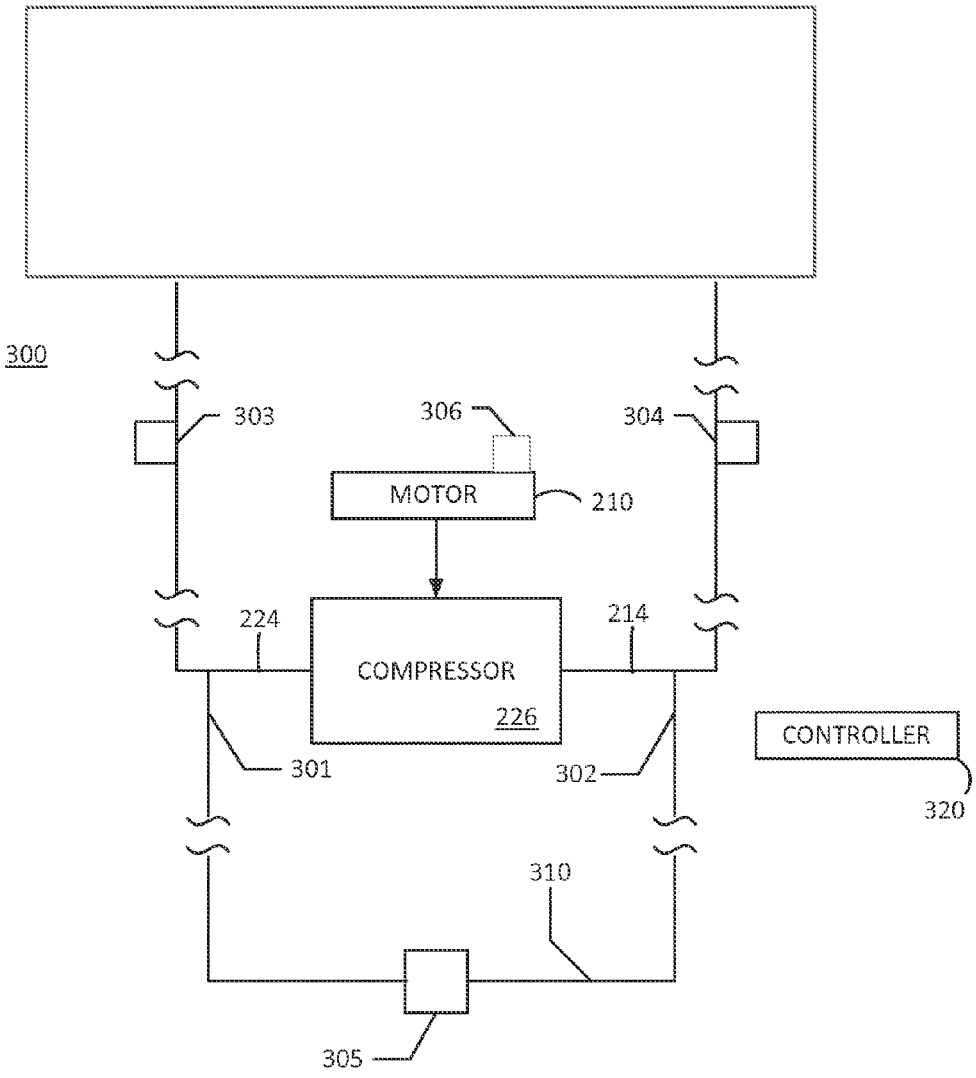
FIG. 3 is a schematic diagram of exemplary components that can be included in a load controller in accordance with some aspects of the disclosure.

Referring now to FIG. 3, a schematic diagram of exemplary components that can be included in a load controller 300 of the refrigerant recovery unit 100 is depicted. In a similar manner to that of previously described embodiments, the load controller 300 can be included in the refrigerant recovery unit 100 to relieve the pressure of the compressor's motor 210 that is subjected to during start up and/or during abnormal refrigerant flow.

Higher pressure loads during the start-up of the motor 210 can be caused, for example, when refrigerant is flowing only from the high side of the refrigerant containing system (not shown) into the refrigerant recovery unit 100 thereby increasing the torque required for the motor 210 to start up. Abnormal refrigerant flow after the refrigerant recovery unit 100 has been running may also occur, for example, due to high back pressure in a refrigerant storing device (not shown) containing refrigerant being recovered, or due to flow restriction caused by contaminants.

A higher than normal pressure load can be lowered by activating a solenoid valve 305 regulating the compressor bypass loop line 310 of the load controller 300. The compressor bypass loop line 310, as previously described, can be formed by incorporating the compressor bypass loop line 310 with the first end 301 connected to a flow path 214 going into an inlet of the compressor 226 and the second end 302 connected to a flow path 224 connected to an outlet of the compressor 226.

The solenoid valve 305 can be activated to open the compressor bypass loop line 310 when the motor 210 is experiencing higher pressure loads. By opening the compressor bypass loop line 310 some of the pressure load can be relieved by allowing some recirculating of the higher pressure from flow path 214 connected to the input of the compressor 226 into the flow path 224 connected to the output of the compressor 226.

In some embodiments of the disclosure, such as in exemplary embodiments depicted in FIGS. 2A and 2B, the solenoid valve 305 activation can be dependent on the motor's 210 start relay. Typically, when the refrigerant recovery unit 100 is powered on, the motor's 210 start windings and run windings can be active thereby causing a significant increase of current drawn by the motor 210. After the motor 210 has started, the significantly higher current draw begins triggering the motor's 210 start relay and deactivating the start windings and run windings. The motor's 210 start relay may be connected to the solenoid valve 305 so that when the motor's 210 start relay is triggered and the motor 210 is attempting to start, the load controller 300 can function to decrease the pressure/current load. The load controller 300 can act simultaneously with the start relay of the motor 210 or wait a few seconds to open the solenoid valve 305. Once the motor 210 is running and normal refrigerant flow begins, the start relay and consequently the load solenoid valve 305 can be deactivated to close the compressor bypass loop line 310. The solenoid valve 305 can be normally remain closed. Similarly, when the motor 210 has been running and abnormal refrigerant flow occurs, the torque and, consequently, the current drawn increases, thereby activating the motor's 210 start relay and load controller 300 to function in the same manner and in doing so, acting as a safety feature.

In a specific example relating to the motor 210 of portable recovery unit such as the RG6000J™ from Robinair™ based in Owatonna, Minn. (Service Solutions U.S. LLC) the motor 210 can run with as little as 5.0 AMPS when there is no pressure on the high side or low side and the start windings of the motor 210 are inactive. During start up and when the start windings are active, the current draw may increase up to about 22 AMPS. The start relay and incorporated load controller 300 of the disclosure can initiate, based on the specifications of the start relay in the motor 210, and in the present example, at a run winding current draw of about 17.0 AMPS that increase during startup up to a maximum of about 22.0 AMPS. The start relay and load controller 300 can remain active until the current begins to drop after the increase to approximately 20 AMPS to begin normal operation with a decreased current/pressure load. For the present example, torque values recorded corresponding to current draw are shown in the following table:

TABLE 1

| Stage | Current Draw | Torque |
|---|---|---|
| Normal Operation | 5.0 AMPS | 16.00 in-lb |
| Activate Start Relay | 17.0 AMPS | 46.71 in-lb |
| Deactivate Start Relay | 20.0 AMPS | 49.00 in-lb |
| Start Load Max | 22.0 AMPS | 50.75 in-lb |

In other embodiments including a controller 320, the load controller 300 of the refrigerant recovery unit 100 can be in logical communication and controlled by a controller 320. The controller 320 can also be in communication with other components including, for example, pressure transducers 303, 304 and/or current meter 306, to monitor the pressure/current load placed on the motor 210. Pressure transducers 303, 304 can monitor pressure on flow path 214 going into the compressor 226 and flow path 224 going out of the compressor 226. The controller 320 can receive data relating to the monitored pressure from one or both of the pressure transducers 303, 304 and activate the load controller 300 when the pressure is outside a pre-determined threshold.

Predetermined thresholds are relative to the torque of the specified motor 210 and may be preprogrammed into software code implemented by the controller's 320 processor. Additionally or alternatively to the pressure transducers 303, 304, current meter 306, and/or flow meters (not shown) may be included in the refrigerant recovery unit 100 to monitor the current load and activate the load controller 300 accordingly.

The controller 320 can be, for example, a microprocessor, a field programmable gate array (FPGA) or application-specific integrated circuit (ASIC) and the like. The controller 320 via a wired or wireless connection (not shown) can control the various components of the refrigerant recovery unit 100. In some embodiments of the present disclosure, any or all of the electronic solenoid valve or electrically activated valves may be connected and controlled by the controller 320.

In some embodiments, aspects of the refrigerant recovery units may be implemented via a control system using software or a combination of software and hardware. In one variation, aspects of the present disclosure may be directed toward a control system capable of carrying out the functionality described herein.

Control system may be integrated with the controller 320 to permit, for example, automation of the recovery processes, including the operation of the load controller 300, self-purge valve 227, inlet valve 212 and outlet valve 242 control, and/or manual control over one or more of each of the processes individually. The control system may also provide access to a configurable database with refrigerant information so the specifications pertaining to a particular motor 210 or part, for example, may be used to provide control and monitor its particular functions. A person skilled in the relevant art(s) will realize that other related systems and/or architectures may be used to implement the aspects of the disclosure.

Figure 4:
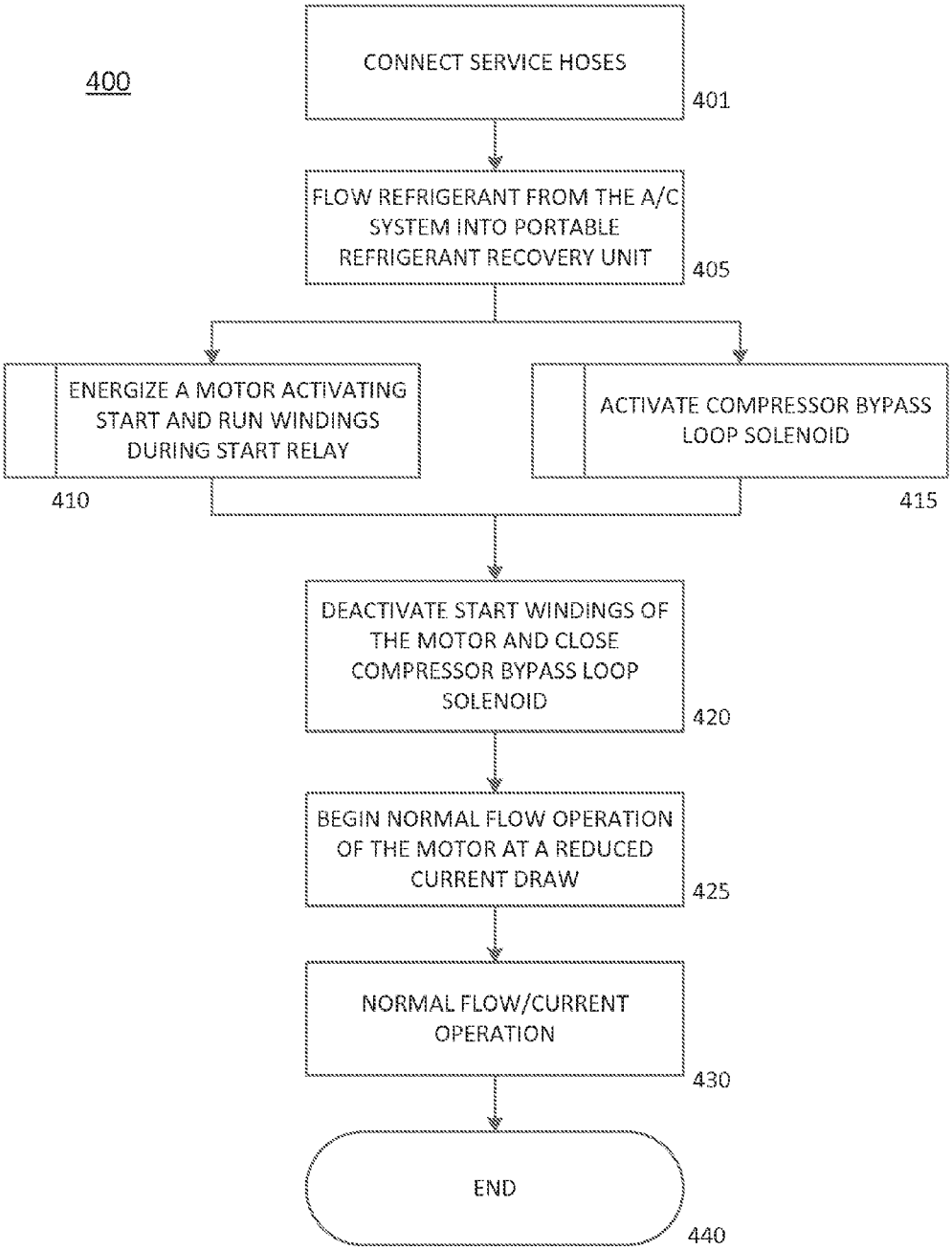
FIG. 4 is a flowchart illustrating method steps that may be used to implement a load controller during activation in accordance to some aspects of the disclosure.
Figure 5:
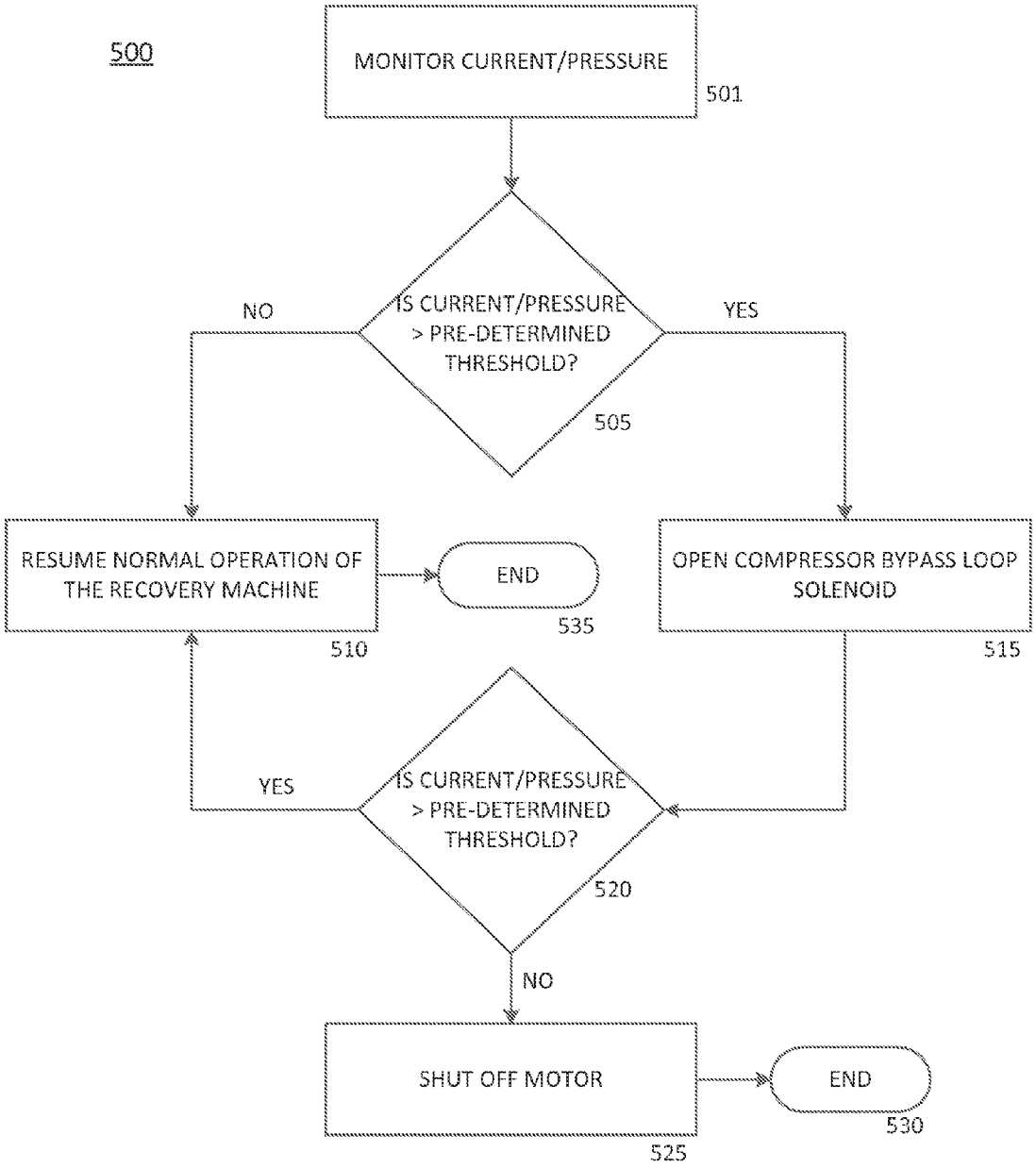
FIG. 5 is a flowchart illustrating steps that may be used to implement a load controller during irregular refrigerant flow in accordance to some aspects of the disclosure.

Disclosed in FIGS. 4 and 5 are associated methods that can be used to implement some aspects of the present disclosure. It is to be understood that methods 400 and 500 can be executed or otherwise performed by one or a combination of various systems such as by the system and components shown in FIGS. 1-3. Each block shown in FIGS. 4 and 5 can represent one or more processes, methods, or subroutines carried out in the exemplary methods 400 and 500. However, the steps may not have to be performed in any certain order or performed at all.

Referring now to FIG. 4, a flowchart 400 with method steps that may be used to implement a load controller 300 during activation in accordance to some aspects of the disclosure is depicted. At step 401, service hoses can be connected to the refrigerant system and the refrigerant recovery unit 100. In some embodiments, service hoses (not shown) can be connected to the inlet fitting 122 used to receive refrigerant from the refrigerant containing system and the outlet fitting 124 used to send the recovered refrigerant back to the refrigerant containing system. At step 405, refrigerant can flow through the service hose connected to the inlet fitting 122 from the refrigerant containing system into the refrigerant recovery unit 100.

At step 410, subsequently the refrigerant recovery unit's 100 motor 210 can be energized to activate start windings and run windings during the start relay function. At step 415, synchronized with the start relay function, or in some embodiments operated by a controller 320, a solenoid valve 305 of the load controller 300 can operate to open the compressor's bypass loop line 310. By opening the compressor bypass loop line 310, some of the pressure can be recirculated and the pressure is thereby lowered, in doing so also lowering the current drawn by the motor 210. Alternatively, the activation of the compressor bypass loop line 310 solenoid 305 can take place a few seconds after.

At step 420, the motor's 210 start windings can be deactivated along with the start relay and the solenoid valve 305 can operate to close the compressor bypass loop line 310 accordingly. At step 425, normal operation of the motor 210 with the lowered current draw resulting from normal refrigerant flow can begin. At step 430, normal operation can resume to complete the recovery, until it is stopped by the user, or until irregular refrigerant flow occurs significantly increasing the pressure load. At step 440, the method 400 ends.

Referring now to FIG. 5, flowchart 500 illustrating steps that may be used to implement a load controller 300 during irregular refrigerant flow is depicted. Because the current drawn by the motor 210 is proportional to the pressure load, at step 501, one or both current and pressure loads can be monitored according to some embodiments of the disclosure. When the current and/or pressure is below a predetermined threshold, determined at step 505. At step 510, normal operation of the refrigerant recovery unit 100 can resume accordingly. However, if the current and/or pressure load changes resulting in an increase above a predetermined threshold, determined at step 505, a solenoid valve 305 of the load controller 300 may be activated to open, at step 515, the compressor bypass loop line 310.

The current and/or pressure can be measured again, at step 520, to determine if the pressure relieved by the load controller 300 was sufficient to lower the current and/or pressure load to an acceptable level. At step 510, normal operation can resume if the change in pressure and/or current load was sufficient to lower the pressure/current load below a predetermined threshold and end at step 525. Alternatively at step 525, if the change was not sufficient to return the current/pressure load to an acceptable level, the load controller 300 may shut off the motor 210 and/or alert the user of the malfunction to allow for proper action and end at step 530.

The many features and advantages of the disclosure are apparent from the detailed specification, and, thus, it is intended by the appended claims to cover all such features and advantages of the disclosure which fall within the true spirit and scope of the disclosure. Further, since numerous modifications and variations will readily occur to those skilled in the art, it is not desired to limit the disclosure to the exact construction and operation illustrated and described, and, accordingly, all suitable modifications and equivalents may be resorted to that fall within the scope of the disclosure.

What is claimed is:

1. A method of controlling a load of a refrigerant recovery unit, the method comprising the steps of:

receiving refrigerant from a refrigerant system through one or more service hoses that provides fluid communication from the refrigerant system to the refrigerant recovery unit;

drawing sufficient current to energize a compressor's motor with a start relay function;

monitoring the current of the compressor's motor with a current meter during the start relay function; and activating, with a load controller, a solenoid valve to open a compressor bypass loop line during the start relay function when the monitored current is above a predetermined current level of a start relay to thereby decrease a pressure load placed on the compressor's motor upon starting.

2. The method of claim 1, wherein the solenoid's activation is synchronized to operate at the same time the start relay of the compressor's motor starts.

3. The method of claim 1, further comprising the step of:

activating, with the load controller, the solenoid valve to close the compressor bypass loop line when the monitored current is below the predetermined current level of the start relay.

4. A method of controlling a load of a refrigerant recovery unit comprising the steps of:

receiving refrigerant from a refrigerant system through one or more service hoses that provide fluid communication from the refrigerant system to the refrigerant recovery unit;

drawing sufficient current to energize a compressor's motor;

monitoring, with a controller, the current drawn by the compressor's motor during a start relay function;

activating, with the controller, a solenoid valve to open a compressor bypass loop line when the monitored current drawn by the compressor's motor is above a predetermined threshold; and shutting off, with the controller, the compressor's motor when the current drawn by the compressor's motor remains above the predetermined threshold.

5. The method of claim 4, further comprising the step of:

continue monitoring, with the controller, the current drawn by the compressor's motor after opening the compressor bypass loop line to determine if the current drawn by the compressor's motor is above or below the predetermined threshold.

6. The method of claim 5, further comprising the step of:

reactivating, with the controller, the solenoid valve to open the compressor bypass loop line upon determining that the monitored current drawn by the compressor's motor is again above the predetermined threshold.

7. The method of claim 4, further comprising the step of:

alerting a user of a possible malfunction.

8. The method of claim 4, wherein a current meter is used to monitor the current drawn by the compressor's motor.

9. A system for controlling a compressor's load in a refrigerant recovery unit, the system comprising:

one or more fittings to connect service hoses that provide fluid communication between a refrigerant system and the refrigerant recovery unit;

a compressor having a motor, an outlet connection and an inlet connection;

a compressor bypass loop line, wherein a first end of the compressor bypass loop line is connected to a first line connected to the inlet connection of compressor and a second end of the compressor bypass loop line is connected to a second line connected to the outlet connection of the compressor;

a load controller in communication with a current sensor that measures a current drawn by the compressor's motor during a start relay function; and a solenoid valve controlled by the load controller to open the compressor bypass loop line during the start relay function when the current drawn by the compressor's motor increases above a predetermined threshold.

10. The system of claim 9, wherein the current sensor is a current meter capable of measuring the current drawn by the compressor's motor.

11. The system of claim 9, wherein the solenoid valve is configured to be controlled by the load controller to open during the motor's start relay function.

12. The system of claim 9, wherein the load controller is additionally operative to shut off the compressor's motor when the current drawn remains above the predetermined threshold subsequent to the opening of the compressor bypass loop line.

13. The system of claim 12, wherein the load controller is in communication with a user interface capable of sending an alert to a user of a malfunction when the current drawn remains above the predetermined threshold subsequent to the opening of the compressor bypass loop line.

14. The system of claim 9, wherein the load controller is a programmable microprocessor included in the refrigerant recovery unit.

15. The system of claim 9, wherein the load controller is operable to electrically operate one or more solenoid valves of the system.

16. The system of claim 15, wherein the operation of the valve control takes place according to predetermined thresholds and one or both measured conditions and preprogrammed operations.

* * * * *